United States Patent [19]

Prodel

[11] 3,972,441

[45] Aug. 3, 1976

[54] PLASTIC BOTTLE CASE

[76] Inventor: Ulrich Heinrich Prodel, Grunstr. 13, D4902 Bade Salzuflen, Germany

[22] Filed: Nov. 4, 1974

[21] Appl. No.: 520,885

[30] Foreign Application Priority Data

Nov. 23, 1973 Germany ..... 2358321

[52] U.S. Cl. ..... 220/21; 206/139

[51] Int. Cl.[2] ..... B65D 1/24; B65D 75/00

[58] Field of Search ..... 220/21, 20, 22, DIG. 2, 220/DIG. 15; 206/139; 217/18, 19, 21, 28

[56] References Cited

UNITED STATES PATENTS

| | | | |
|---|---|---|---|
| 3,055,542 | 9/1962 | Russo | 220/DIG. 15 |
| 3,338,406 | 8/1967 | Anderson | 206/139 |

*Primary Examiner*—William Price
*Assistant Examiner*—Steven M. Pollard
*Attorney, Agent, or Firm*—Robert E. Burns; Emmanuel J. Lobato; Bruce L. Adams

[57] ABSTRACT

A plastic bottle case adapted to receive for transport and storage bottles in carriers and also individual bottles has side walls which are higher than the bottles, a bottom spaced upwardly from the lower edges of the side walls and adapted to support bottles in carriers. The bottom has holes to receive individual bottles not in carriers with bottle receptacles comprising ribs extending downwardly from edges of the openings and horizontal ribs connecting the downwardly extending ribs. Portions of the bottom between the openings are preferably crowned or roof-shaped.

12 Claims, 3 Drawing Figures

PLASTIC BOTTLE CASE

FIELD OF INVENTION

The present invention relates to a plastic bottle case adapted to receive for transport and storage bottles in carriers or "packs" and also individual bottles which are not in carriers.

BACKGROUND OF INVENTION

There has previously been proposed a stackable plastic bottle case having four side walls and a bottom, the interior of the case being divided into individual bottle compartments by partitions having a height equal approximately to half the height of the bottles. With such a bottle case it is possible to transport loose bottles as well as bottles packed in carriers. If loose bottles are to be transported they are received in the individual bottle compartments and are kept from bumping one another by the partitions. If the bottles are packed in carriers, the carriers rest on the upper edges of the partitions. The height of the side walls of the case must hence be at least equal to the height of the partitions plus the height of the bottles to be transported. As the bottles in carriers are closer together than loose in the case, the space occupied by carriers in a case is less than the interior area of the case. To keep the carriers from shifting in the case portions of the partitions adjacent the side walls rise abruptly to provide abutments which engage the carriers and hold them in place. While body cases in accordance with the foregoing proposal have the advantage of providing for the transport of loose bottles as well as bottles in packs thereby making it possible to use reusable bottles, they have had the disadvantage that the cases have had to be considerably higher than ordinary bottle cases thereby occupying more space in transportation and storage.

SUMMARY OF INVENTION

It is an object of the present invention to provide a further improvement in bottle cases in that the individual bottle compartments can be lower so that the overall height of the case can be materially decreased.

The invention stems from the realization that since empty bottles are customarily put in a bottle case by hand the individual bottle receptacles can be smaller than is required for machine insertion. The diameter of the bottle receptacles is decisive for the stability of the bottles during transport. In a narrow bottle receptacle the bottle can move considerably less and can tilt to a considerably smaller angle than in wider bottle receptacles. It is hence possible to decrease the depth of the bottle receptacles materially and yet provide sufficient stability to prevent the bottles from bumping one another during transport.

In accordance with the present invention, a plastic bottle case adapted to receive bottles in carriers as well as individual bottles comprises side walls and a bottom spaced upwardly from lower edges of the side walls and adapted to support bottles in carriers. The bottom has openings to receive individual bottles and bottle receptacles for receiving and supporting the bottles extend down from the edges of the openings a distance approximately equal to and not exceeding the spacing of the bottom from the lower edges of the side walls of the case. The bottle receptacles preferably comprise ribs extending downwardly from the edges of the openings in the bottom of the case and horizontal ribs connecting the downwardly extending ribs. As the receptacles are thus mostly open, dirt cannot become trapped in them and the receptacles are thus self cleaning.

With a bottle case in accordance with the present invention, bottles in carriers are supported by the floor of the case and are hence supported more firmly than by the upper edges of the partitions of the above mentioned prior case. As the carriers rest on the elevated floor of the case above the bottle receptacles they can be filled with presently available automatic bottle packing machinery either before or after the carriers are inserted in the bottle case. There is no need of designing special machinery to insert bottles in the individual bottle receptacles since empty bottles to be returned to the bottler are customarily inserted in the bottle receptacles by hand. It is hence possible to make the individual bottle receptacles small so as to receive a lower portion of the bottle snugly and hold it firmly so that the individual bottles will not bump and damage one another while being shipped back to the bottler.

The bottle case in accordance with the present invention has the further advantage that since the side walls are not as high as in the previously mentioned case and since there are openings in the bottom, less plastic material is required in the manufacture of the case.

Preferably, the floor between the openings as well as between the openings and the side walls is preferably crowned or roof shaped. The roof shape preferably has a small angle of inclination. By reason of this roof shape, wash water can readily run off when the cases are washed by hand or by machinery. Moreover, the roof shape configuration strengthens the bottom and facilitates insertion of bottles into the bottle receptacles. Moreover, it is sometimes preferable for the ribs to be rounded so that the bottles can be more easily inserted.

The bottle case is preferably provided with supporting ribs which project inwardly from the side walls of the case and engage bottle filled carriers placed in the case to hold the carriers spaced from the side walls. An advantage of the bottle case in accordance with the present invention in comparison with the prior bottle case mentioned above is that these supporting ribs do not need to be aligned with the partitions but can be positioned at locations where they most favorably support the carriers placed in the case. The supporting ribs need to be provided only above the elevated bottom of the case.

DESCRIPTION OF DRAWINGS

The nature, objects and advantages of the invention will be more fully understood from the following description of preferred embodiments shown by way of example in the drawings in which.

DESCRIPTION OF PREFERRED EMBODIMENTS

Figure 3:
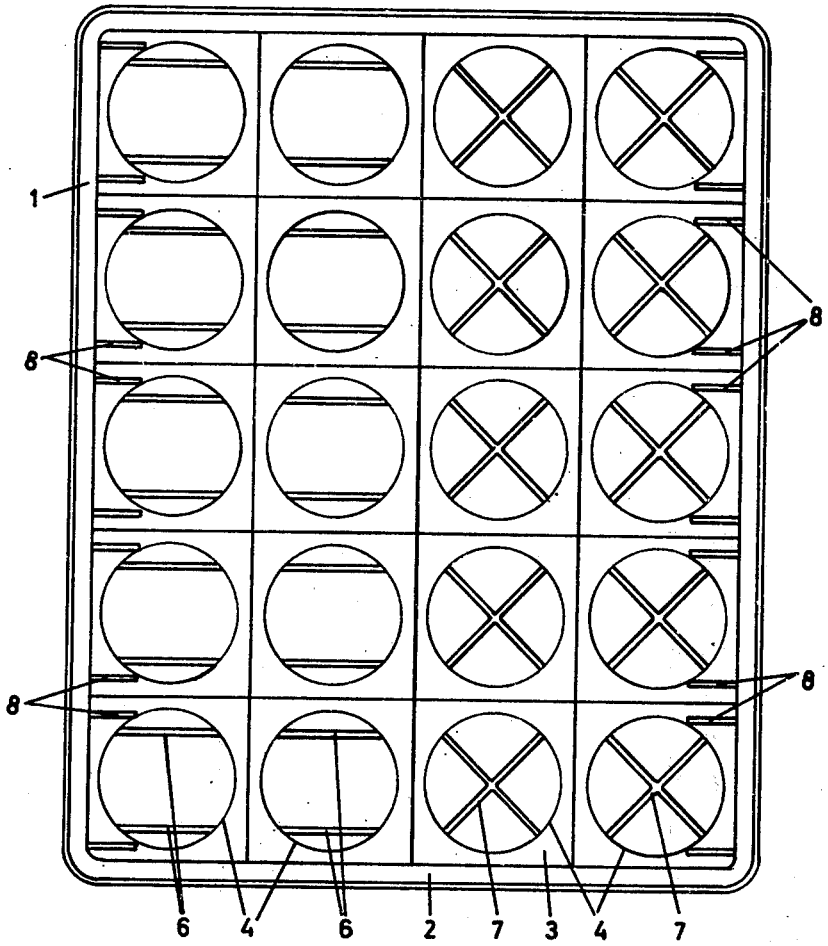
FIG. 3 is a plan view of the bottle case shown empty.

The plastic bottle case shown by way of example in the drawings has side walls 1 and 2 which are reinforced at their lower edges and are provided at their upper edges with angular flanges 1*a* and 2*a* respectively so that the bottle cases can be stacked. The case has a bottom 3 which is located above the lower edges of the side walls 1 and 2 so that it is spaced by a distance A from the lower edges of the side walls. The bottom is provided with openings 4 of a size snugly to receive the bottles for which the case is designed. The openings 4 are preferably circular and are located in a suitable arrangement or pattern as illustrated in FIG. 3. Bottle receptacles extend downwardly from the edges of the openings 4 to receive and support bottles placed in the openings. The bottle receptacles advantageously comprise at least two and preferably three or four vertical ribs extending downwardly from the edges of the openings 4 and horizontal ribs extending between lower ends of the vertical ribs. In the left hand side of the case as seen in the drawings the bottle receptacles are shown as comprising four vertical ribs 5 extending downwardly from the edges of the openings 4 in the bottom of the case and parallel ribs 6 connecting pairs of the vertical ribs. In the right hand side of the case as shown in the drawings the bottle receptacles comprise four equally spaced vertical ribs 5 extending down from the edges of the openings in the bottom of the case and crossing ribs 7 connecting opposite ones of the vertical ribs. The ribs forming the bottle receptacles are preferably of circular cross section or have their inner faces rounded to facilitate entry of bottles into the bottle receptacles and cleaning of the case.

Figure 2:
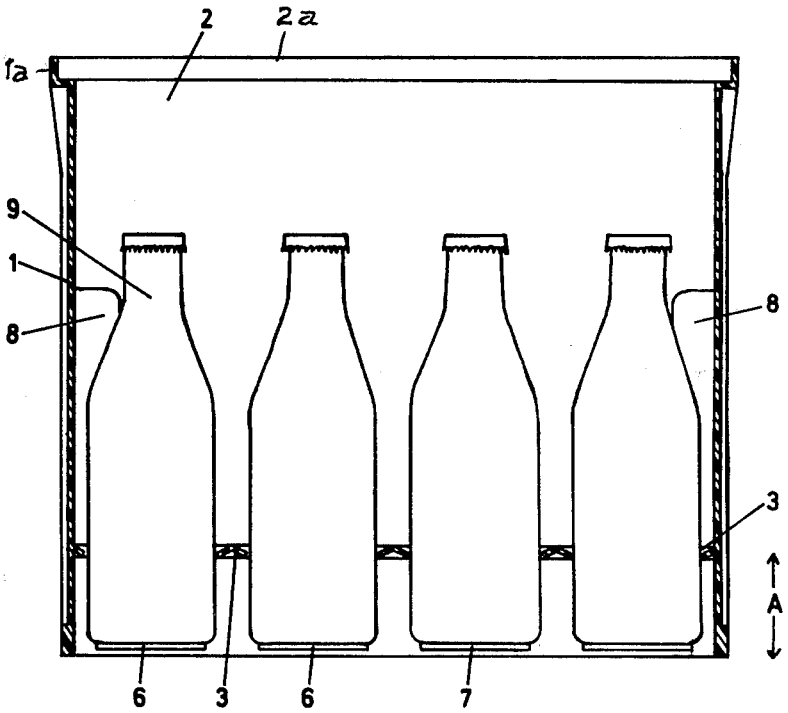
FIG. 2 is a section through the bottle case containing individual bottles not in packs.

When bottles are placed in the case without a carrier as illustrated in FIG. 2 lower portions of the bottles extend through the openings 4 in the bottom of the case and are received in the bottle receptacles formed by the ribs 5 and 6 or ribs 5 and 7. The holes 4 in the bottom of the case and the bottle receptacles depending from the edges of the holes are of a size snugly to grip the lower portions of the bottles so as to hold the bottles spaced from one another and prevent them from tipping. If desired, the vertical ribs 5 can be formed so as to bow inwardly and thereby grip the bottles resiliently when inserted in the receptacles. By reason of the bottles fitting snugly in the openings 4 in the bottom of the case and the bottle receptacles depending from the edges of the openings, the bottom can be located relatively low in the case. For example, the distance A which the bottom is spaced from the lower edges of the side walls can be approximately twenty to thirty percent of the height of the side walls. The ribs 6 or 7 defining the bottoms of the bottle receptacles are located approximately in the plane of the lower edges of the side wall. It is sufficient for the bottles to extend into the bottle receptacles a distance equal to approximately one third or even less of the height of the bottles. By reason of the firmness with which the bottles are held in the receptacles, they are prevented from bumping one another during shipment even though the receptacles are relatively shallow.

The portions of the bottom 3 between the openings 4 and between the openings and the side walls of the case are preferably crowned or roof shaped so as to be inclined downwardly toward the openings. The angle of inclination is small, for example about 15° to 30°. This configuration not only strengthens the bottom but also makes the case easier to clean either by hand or by machine since wash water runs off of the bottom into the openings 4. As the bottle receptacles formed by the vertical and horizontal ribs are mostly open there is no place for water or dirt to be trapped. This further facilitates cleaning and provides a highly sanitary case.

Figure 1:
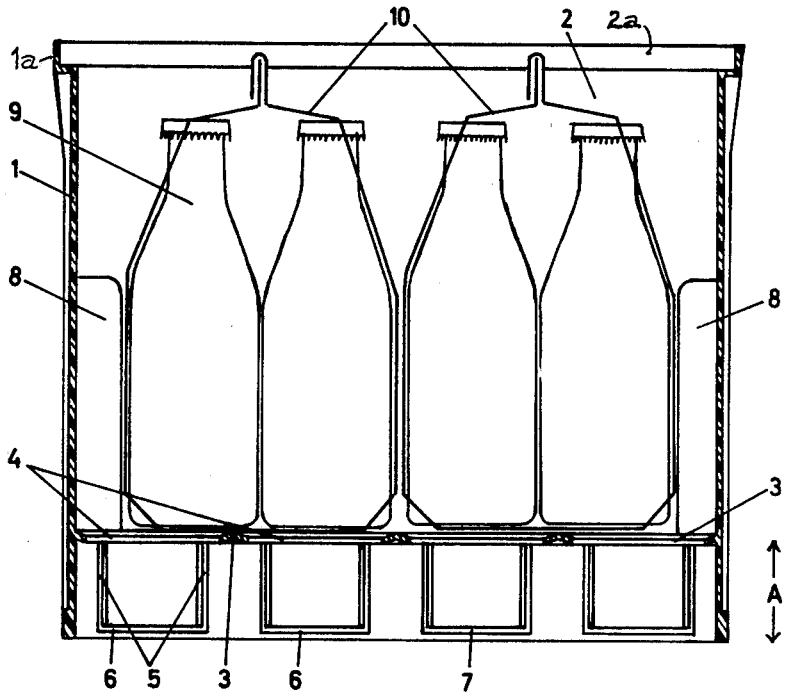
FIG. 1 is a section through a bottle case in accordance with the invention with bottles in carriers or packs.

When bottles packed in carriers are placed in the case, the carriers rest on the elevated bottom 3 as illustrated in FIG. 1. The bottom provides a firm and solid support for the carriers. Although the case is deep enough to accommodate bottles in carriers resting on the bottom 3, the overall height of the case is less than that of the prior case mentioned above by reason of the low position of the bottom 3 as has been described.

As bottles packed in a carrier as illustrated in FIG. 1 are closer together than individual bottles placed in the case as illustrated in FIG. 2, the area occupied by the carriers is less than the interior area of the case. Accordingly, means is provided for holding the carriers to prevent their shifting in tthe case during transport. The positioning means is shown as comprising flanges or ribs 8 which project inwardly from the side walls and position the filled bottles carriers in spaced relation to the side walls as seen in FIG. 1. It will be seen that the ribs 8 are located only above the bottom 3. In contrast with the priorr bottle case mentioned above where the carriers were positioned laterally by upwardly extending portions of partitions separating the bottle compartments, there is more freedom in locating the ribs 8 of the bottle case of the present invention so as to provide optimum lateral support for the filled carriers. As illustrated by way of example in FIG. 3 the supporting ribs 8 are located in pairs between successive openings 4 formed in the bottom of the case. As thus positioned, the ribs 8 do not interfere with insertion of individual bottles into the openings 4. The ribs 8 preferably extend up from the bottom 3 a distance equal to about half the height of the bottles.

While preferred embodiments of the invention have been illustrated in the drawings and are herein particularly described, it will be understood that modifications can be made and that the invention is in no way limited to the illustrated embodiments.

What I claim and desire to secure by Letters Patent is:

1. A bottle packing comprising a unitary plastic bottle case adapted to receive bottles in carriers and also individual bottles not in carriers, said case comprising side walls and a bottom spaced upwardly from lower edges of said side walls, a plurality of bottle carriers received in said case and supported by said bottom, a plurality of bottles received in each of said carriers and means for securing said carriers from shifting laterally in said case, said means comprising support portions projecting inwardly from side walls of said case above said bottom in position to engage and position carriers in said case, said bottom having spaced openings to receive individual bottles not in carriers and bottle receptacles extending down from the edges of said openings a distance equal to the spacing of the bottom from the lower edges of the side walls of said case.

2. A bottle packing according to claim 1, in which said bottle receptacles comprise ribs extending downwardly from the edges of said openings in the bottom of said case and horizontal ribs connecting said downwardly extending ribs.

3. A bottle packing according to claim 1, in which portions of the bottom of said case between said openings are roof-shaped so as to slope downwardly to said openings.

4. A bottle packing according to claim 1, in which the bottom is spaced from the lower edges off the side walls a distance equal to about 15% to 30% the height of the side walls.

5. A bottle packing according to claim 1, in which said openings are of a size to receive said bottles snugly to restrain said bottles from tipping and striking one another.

6. A bottle packing according to claim 1, in which said receptacles have resilient side portions for gripping said bottles to restrain them from tipping and striking one another.

7. A bottle packing according to claim 1, in which said receptacles are open to permit drainage of liquid therefrom.

8. A bottle packing comprising a unitary plastic bottle case adapted to receive bottles in carriers and also individual bottles not in carriers, said case comprising side walls and a bottom spaced upwardly from lower edges of said side walls, a plurality of bottle carriers received in said case and supported by said bottom, a plurality of bottles received in each of said carriers and means for securing said carriers from shifting laterally in said case, said bottom having spaced openings to receive individual bottles not in carriers and bottle receptacles extending down from the edges of said openings a distance equal to the spacing of the bottom from the lower edges of the side walls of said case, said bottle receptacles comprising ribs extending downwardly from the edges of said openings in the bottom of said case and horizontal ribs connecting said downwardly extending ribs.

9. A bottle packing according to claim 8, in which said downwardly extending ribs are resilient and are positioned to grip said bottles to restrain them from tipping and striking one another.

10. A bottle packing according to claim 8, in which portions of the bottom of said case between said openings are roof-shaped so as to slope downwardly to said openings.

11. A bottle packing comprising a unitary plastic bottle case adapted to receive bottles in carriers and also individual bottles not in carriers, said case comprising side walls and a bottom spaced upwardly from lower edges of said side walls, a plurality of bottle carriers received in said case and supported by said bottom, a plurality of bottles received in each of said carriers and means for securing said carriers from shifting laterally in said case, said bottom having spaced openings to receive individual bottles not in carriers and bottle receptacles extending down from the edges of said openings a distance equal to the spacing of the bottom from the lower edges of the side walls of said case, portions of the bottom of said case between said openings being roof-shaped so as to slope downwardly to said openings.

12. A bottle packing according to claim 11, in which said receptacles are open to permit drainage of liquid therefrom.

* * * * *